US005605257A

United States Patent [19]

Beard

[11] Patent Number: 5,605,257

[45] Date of Patent: Feb. 25, 1997

[54] STERILE LIQUID SQUEEZE-BOTTLE-TYPE DISPENSER

[76] Inventor: Walter C. Beard, P.O. Box 340, Middlebury, Conn. 06762

[21] Appl. No.: 610,228

[22] Filed: Mar. 4, 1996

[51] Int. Cl.[6] ..... B65D 37/00

[52] U.S. Cl. ..... 222/189.09; 222/213; 222/509; 222/514

[58] Field of Search ..... 222/96, 207, 209, 222/212–214, 189.09, 505, 509, 512–514, 518, 522–525

[56] References Cited

U.S. PATENT DOCUMENTS

| | | | |
|---|---|---|---|
| 2,772,817 | 12/1956 | Jauch | 222/213 |
| 2,927,717 | 3/1960 | McDermottt | 222/213 |
| 4,570,829 | 2/1986 | Allen | 222/214 |
| 4,917,271 | 4/1990 | Kanner et al. | 222/213 |
| 5,370,313 | 12/1994 | Beard | 222/514 |

*Primary Examiner*—Andres Kashnikow
*Assistant Examiner*—Philippe Derakshani
*Attorney, Agent, or Firm*—Dallett Hoopes

[57] ABSTRACT

Dispenser has a nozzle with a tip seal valve and an internal check valve defining a discharge chamber between them. The tip seal valve actuator extends along the squeeze bottle side so that it can be actuated at the same time as the bottle is squeezed. Because of the check valve, there is no "suck back" as bottle is released. A bottle vent permits air in, but does not allow liquid to escape.

13 Claims, 3 Drawing Sheets

STERILE LIQUID SQUEEZE-BOTTLE-TYPE DISPENSER

FIELD OF THE INVENTION

This invention relates to a dispenser for sterile liquids. More specifically, this invention relates to a sterile liquid dispenser in the form of a squeeze bottle.

BACKGROUND OF THE INVENTION

In most dispensers for sterile liquids in the past it has been necessary to add preservatives to the liquid to render innocuous any contaminates that find their way into the dispensing container or discharge passages. Because such preservatives have caused irritations of tissues, there has been a desire to eliminate them and, hence, a need for a dispensing system designed to keep contaminates out.

In my earlier patent U.S. Pat. No. 5,370,313 issued Dec. 6, 1994, I disclosed a sterile liquid dispenser in the form of a pocket-sized container made to dispense liquid in a sterile way. Because the dispenser is especially designed with an effective tip seal, it makes it possible for the first time to provide a handy dispenser for eye care liquids, for instance, without the need for blending into the treatment solution a preservative. This is more fully described in my earlier patent, and the entire earlier disclosure is incorporated hereinto by reference.

My earlier invention in patent U.S. Pat. No. 5,370,313 contemplated a "bottle under pressure" with a tip seal. The "bottle under pressure" is disclosed as a container enclosing, in addition to the product, a discharge assistant, such as a propellant generating pressure, a compressed gas or a bag under external pressure. While a plastic squeeze bottle, when squeezed, is clearly a "bottle under pressure", heretofore my earlier invention of patent U.S. Pat. No. 5,370,313 has not been used with squeeze bottles. This is because when a squeeze bottle is released there has been an inevitable "suck back" of air through the discharge passage. If such "suck back" is prior to seating of the tip seal, it effects the "inhaling" of contaminates into the outlet to reside and grow, making an unacceptable situation for liquids required to be sterile.

Because, as described in my earlier patent, the optical industry has customarily packaged eye treating liquids in squeeze bottles, and the public is used to such packaging, there is a need for a squeeze bottle dispenser for sterile liquids. It is to this need that the present invention is directed.

SUMMARY OF THE INVENTION

The present invention, then, is a sterile liquid dispenser comprising a squeeze bottle having a dispensing head closing its mouth. The head is similar to that of my earlier patent additionally including a separate discharge chamber in the dispenser stem. The chamber is disposed between a check valve located between the chamber and the inside of the bottle and the tip seal valve at the discharge. The dispenser is also formed with a vent from the outside of the bottle to the interior. Preferably the vent is in a passage in the dispensing head and fitted with a hydrophobic filter, suitable for excluding bacteria, permitting air in, but not allowing liquid to escape.

BRIEF DESCRIPTION OF THE DRAWINGS

Further objects and features of the invention will be apparent to those skilled in the art from a study of the following specification and the accompanying drawings, all of which disclose a non-limiting embodiment of the invention. In the drawings.

DESCRIPTION OF THE PREFERRED EMBODIMENT

Figure 1:
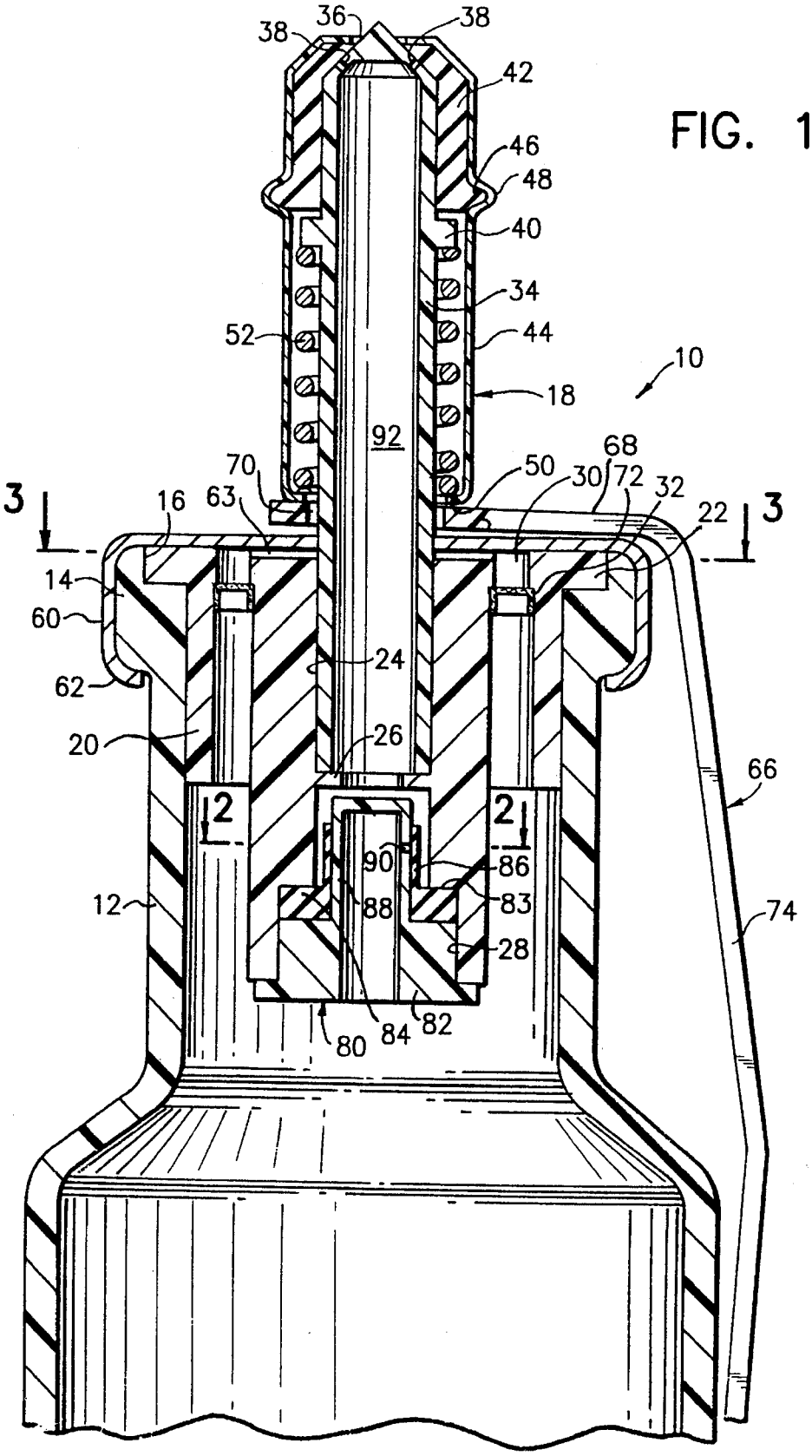
FIG. 1 is a fragmentary sectional view of the upper portion of a dispenser embodying the invention.
Figure 2:
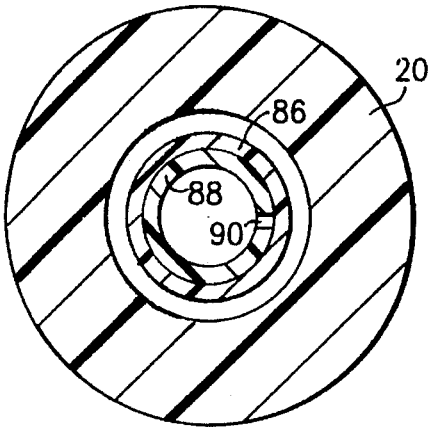
FIG. 2 is an enlarged sectional view taken on the line 2—2 of FIG. 1.

A dispenser embodying the invention is generally designated 10 in FIG. 1. It comprises a bottle or container 12 of the squeeze bottle type made of a resilient plastic such as polyethylene and having side walls which may be pressed inward during the dispensing operation to create pressure inside the container. The container is formed with a mouth 12 having a thickened upper end 14 and an annular recess 16 about the mouth opening.

The dispenser further comprises a discharge head generally designated 18. The head comprises a cylindrical plug 20 having a peripheral flange 22 about its upper end. The plug has a unitary central portion and is formed with a central bore 24 which may be reduced intermediate its ends to form an annular inward shoulder 26. The central bore is enlarged at its lower end as at 28.

Spaced uniformly about the opening 24 are individual vent passages 30. The passages 30 are covered at the upper end by a hydrophobic microporous membrane as widely used in the medical device industry for excluding bacteria.

A tubular stem 34 comprises another part of the dispensing head. Its lower end extends snugly into the bore 24 and bottoms out on the shoulder 26. The upper end of the stem 34 may be pointed or sloped as at 36 and provided with dispensing orifices 38 on the slope. Intermediate its ends the stem 34 is provided with a peripheral flange 40.

A discharge valving gasket 42 having an internal shape generally conforming to the pointed end 36 and the adjacent cylindrical surface is disposed thereagainst. It normally overlies the discharge orifices 38 and seals them off. It is snugly embraced by a shell 44 which may be of metal or plastic and covers at least part of the top portion of the gasket as shown. To accommodate an annular bump 46 on the gasket, the shell is bulged out as at 48 anchoring the gasket in position inside the shell. Other gasket/orifice arrangements are fully disclosed in my earlier patent '313.

The shell with its gasket and stem comprise a sort of "nozzle" for the dispenser.

The lower end of the shell is crimped inward as at 50 to be adjacent to the circumference of the tubular stem 34 but is readily movable therealong. Inside the shell an axial spring 52 surrounds the stem and is compressibly disposed between the flange 40 and the inward crimp 50 on the seal. This, of course, biases the discharge valve closed.

An apertured metal ferrule 60 is disposed against the top of the plug 20 and has a depending skirt which encloses the flange 14 of the bottle. The lower portion of the skirt is crimped inward as at 62 under the flange 14 to secure the plug 20 in place. An annular depression 63 in the top of the plug 22 provides an air passage into the opening in the ferrule, as shown in FIG. 1.

A generally L-shaped actuator lever 66 is provided and comprises a short arm 68 having an opening 70 therein which receives the tubular stem. Surrounding the opening the short arm 68 is disposed between the bottom of the shell 44 and the ferrule 60. Adjacent the bend in the L-shaped lever the short arm 68 rests on the top of the ferrule 60 as at 72. The long arm at 74 of the L-shaped lever 66 extends down to a position by the side of the bottle so that the lever may be worked as the bottle is squeezed. This working of the lever about the fulcrum 72 causes the shell 44 to rise, unseating the gasket 42 to permit discharge.

The device thus far described is generally similar to the sterile liquid dispenser disclosed in my patent '313. Aside from cosmetic differences, there is, of course, the difference of the passages 30 providing a vent which is occluded by the hydrophobic material 32.

An essential of the present invention is the resilient check valve assembly generally designated 80. As described, the opening in the lower end of the plug is enlarged as at 28. It receives the cylindrical insert 82 which is press-fitted into the enlarged opening 28 and clamps the valve 83 against the shoulder at the upper end of the enlargement 28. The valve comprises flange 84 and a unitary resilient sleeve 86 which hugs about an inverted cup-shaped extension 88 of the insert 82. Under the sleeve 86 the extension 88 is apertured as at 90.

The resilient check comprising the opening 90 and the sleeve 86 is adapted to permit liquid within the squeeze bottle to move out the passage 90 as the sleeve 86 yields outward under pressure. Clearance is provided around the sleeve for this purpose. The resilient sleeve 86 is naturally biased toward closed position hugging the extension and normally closing off the passage 90 to reverse flow.

The hollow volume inside the stem 34 and plug 20 between the dispensing parts or orifices 38 and the check valve 86, 90 may be regarded as a "discharge chamber" with the end of orifices 38 being the distal or "outer end" and the end of the check valve being the proximate or "inner end". The dispensing chamber is broadly designated 92.

Thus, when the bottle is inverted and the long arm 74 of the lever 70 is pressed against the bottle and the bottle is manually compressed simultaneously, liquid passes through passage 90, flexing the sleeve 86, into the inner end of the chamber. Then, as the shell moves away from plug 20, the gasket 42 unseats, and liquid moves out the discharge orifices 38 at the outer end of the discharge chamber 92.

Upon the subsequent releasing of the squeeze bottle and arm 74, those two elements tend to resume their original shape and position due the "set" of the bottle and to spring 52. As the squeeze bottle commences restoring itself to original position, there will be created a vacuum within it and a tendency to draw liquid back from the discharge chamber and into the container. This is, however, thwarted as the resilient sleeve 86 has seated over the opening 90. This total prevention of movement of liquid from the chamber 92 into the container has the effect of obviating any negative pressure in the chamber itself. Hence, there is no back flow of liquid or air through the orifices 38, even during the instant of time that the gasket 42 has not yet completely seated. As a result, there is no "sucking back" of contaminates from the area around the tip of the stem. Indeed, as the gasket 42 seats, it displaces any liquid on the outside of the point 36.

The flow of liquid from the discharge chamber into the container itself is effectively thwarted and the bottle cannot "inhale". This tends to keep the side walls of the container in collapsed condition. The passages 30 and the hydrophobic material 32 now provide a path for venting, and air flowing into the container through passages 30 brings the internal pressure up to atmospheric pressure as the container resumes the normal shape.

Thus, an essential part of this invention is the provision of the check valve assembly 80. Another essential addition is the provision of the vent. The vent may take many forms including microporous membrane in one of the walls or bottom of the container. The preferred form is passages 30 and the hydrophobic material 32 as described. Such hydrophobic material may be in the form of a microporous membrane available from Gelman Sciences, Membrane and Devices Division of Ann Arbor, Mich. 48106 under the trademark "VERSAPOR". Preferably such a membrane may be insert-molded into the plug 20 of the dispensing head.

Figure 5:
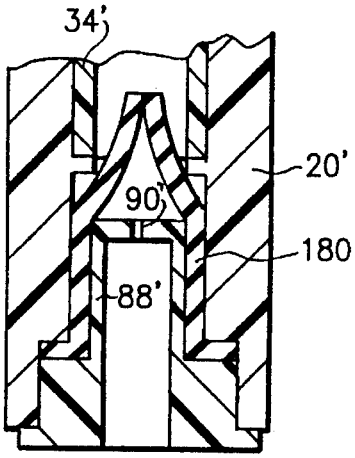
FIG. 5 is a fragmentary sectional view of a modified check valve arrangement.
Figure 3:
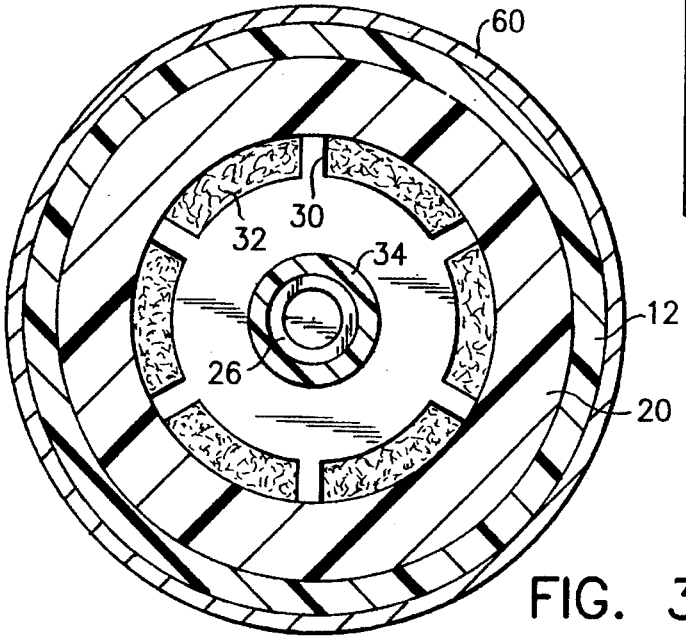
FIG. 3 is a sectional view taken on the line 3—3 of FIG. 1.
Figure 4:
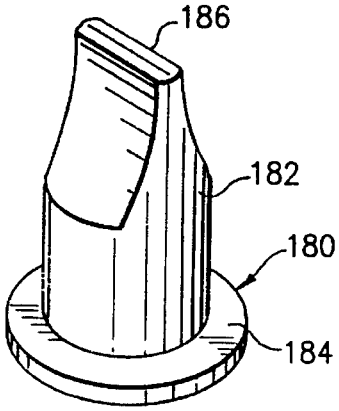
FIG. 4 is a perspective view of a modified check valve for use with the invention.

An alternate version of the check valve usable in the invention is a duck bill check which is shown in FIGS. 4 and 5. Such a modified check may comprise a tubular cylindrical body 182 provided with a peripheral flange 184 and the usual duck bill opening 186. Such a valve may be a stock item supplied, for instance, by Vernay Laboratories of Yellow Springs, Ohio.

FIG. 5 shows the modified version of check clamped into the lower end of the plug 20' being comparable to the plug 20 of the first described embodiment. Because the check 180 opens axially, there is no need for clearance about the valve 180 as there was with the resilient sleeve 86. Further, the upward extension 88' may have its passage 90' in the top wall of that extension.

Modification

Figure 6:
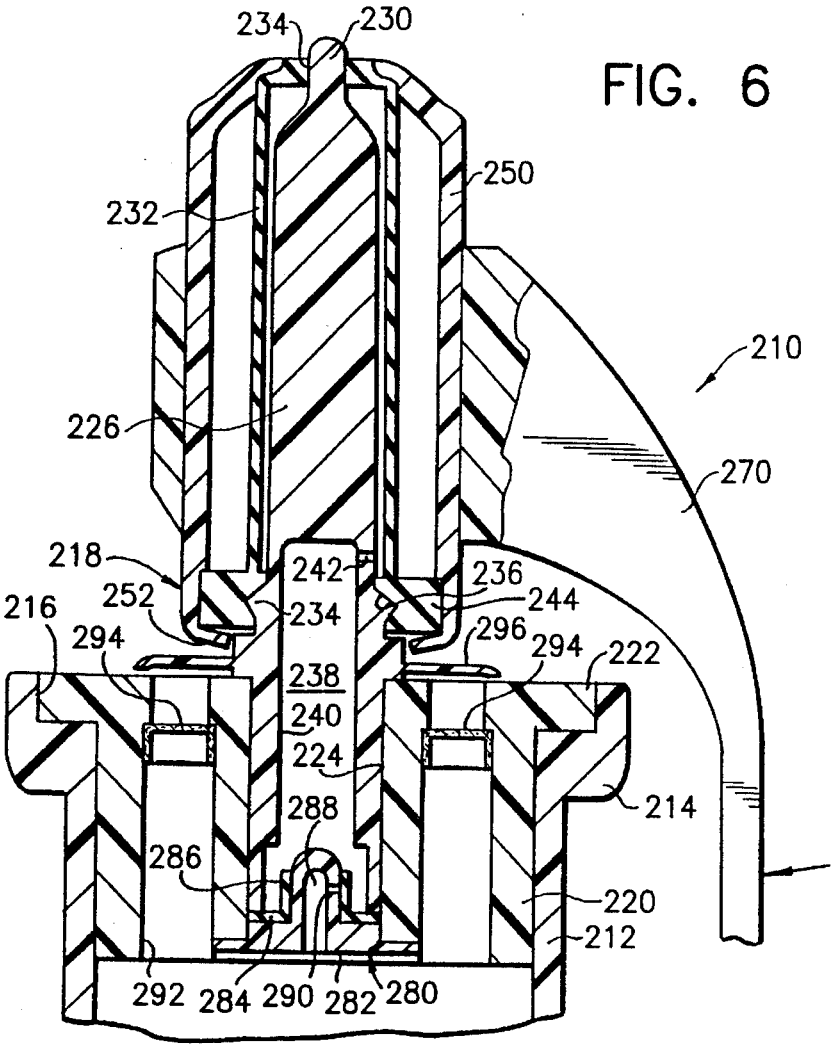
FIG. 6 is a fragmentary sectional view of a modified form of a dispenser embodying the invention.
Figure 7:
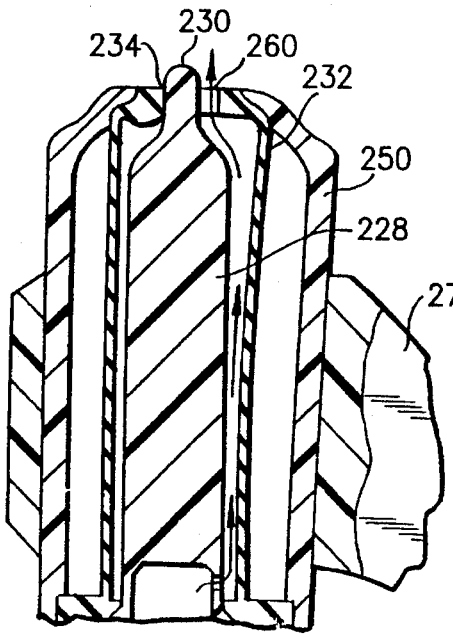
FIG. 7 is a view of a portion of FIG. 6 with the valve activated to open position.

A modified form of the invention is shown in FIGS. 6 and 7.

In the FIGS. 6, 7 embodiment the dispenser is generally designated 210 and comprises a container 212 having an enlarged flange 214 about its mouth. The mouth opening is recessed at 216. The dispensing head 218 comprises a plug 220 having an outward flange 222 complementing recess 216. The plug is press-fitted into the opening in the container.

The plug 220 has a central bore 224 into which a stem 226 is rigidly fitted. The stem 226 has a reduced distal tip 230. Gasket 232 has a generally inverted cup shape. The gasket has a central opening 234 in its top wall and an internal groove 236 about its mouth. The gasket fits over the stem, the tip 230 sealingly received into the opening. The groove 236 snaps over the rib 234. The stem 226 as shown is hollow at its lower end 240 and has a radial port 242. The side walls of the gasket comprise further enclosure means for the discharge chamber.

The lower end of the gasket has an outward flange 244. A shell 250 surrounds the flange 244 and is crimped inward thereunder as at 252. The shell 250 is fixedly embraced by the upper end of an actuator lever 270, the lower end of which extends down along the side wall of the squeeze bottle container (not shown). As a result of this structure, when the lever is squeezed toward the container the shell 250 shifts laterally to the right at the top (FIG. 7) to permit an opening or discharge orifice 260 between the gasket opening 234 and the tip 230.

To explain further the operation of the tip valve, reference is made to the Hug patent U.S. Pat. No. 3,489,323 issued Jan. 13, 1970.

A check valve assembly 280, similar in effect to the assembly 80 of the first embodiment, is inserted in the lower end of the plug 220 (FIG. 6). The assembly comprises an insert 282 and a valve 283. The valve 283 is defined by a resilient sleeve 286 having a flange 284 at its lower end, the flange being rigidly clamped between the plug 220 and insert 282. The insert, as before, has an inverted cup-shaped projection 288 with a lateral port 290. The resilient sleeve normally covers this opening and provides the check valve function as with the earlier described embodiment.

The plug 220 also incorporates the vent passages 292 covered by the hydrophobic membrane 294 as described. The stem assembly may include the outward guard 296 which protects but does not close off the top of the passages 292.

In the modification, the volume above the check valve 286, 290, out the port 242 and around the stud inside the gasket up to the outlet orifice or discharge valve 234 may be considered the "discharge chamber".

The operation of the modification is similar to the operation of the first embodiment. When unit is inverted and the lever is squeezed against the side wall of the squeeze bottle and the walls of the squeeze bottle collapse, liquid is forced through the check valve 286, 290 into the discharge chamber defined above and up and out through the discharge orifice 260 (FIG. 6).

Subsequently, when the lever and squeeze bottle are released, the shell 250 returns to its normal position due to the resilience of the flange 244 and the resilience of the top wall of the gasket surrounding the opening 234. As the container 212 seeks to restore itself to its "set" original shape, a negative pressure is created because the check valve 286, 290 does not permit reverse liquid flow back into the container from the discharge chamber.

The negative pressure inside the container is vented through the passages 292, as with the earlier embodiment. The hydrophobic membrane 294 permits venting but does not permit outward flow of liquid. With the dispenser now restored to its original condition, it is ready for a further use.

It will be clear to those skilled in the art that the present invention provides a sterile dispenser in the form of an ordinary squeeze bottle. Because of the provision of the check valve between the discharge chamber and the container interior, the possibility of "suck back" of contaminates through the dispensing orifice is eliminated. The net effect is that liquids which used to require additions of preservatives to keep them sterile are no longer under such requirement and the tissue-irritating preservatives can be eliminated.

While the invention is shown in a limited number of forms and embodiments, it is limited only by the following claim language which may be extended by an enlargement of the right to exclude as is appropriate under the doctrine of equivalents.

What is claimed is:

1. A squeeze bottle dispenser comprising a resilient bottle and a connected discharge nozzle having a proximate end adjacent the bottle and a distal end, the nozzle enclosing a discharge chamber having a discharge valve at the distal end and a check valve at the proximate end permitting flow only into the discharge chamber from the bottle, an actuator for the discharge valve extending along a side wall of the bottle so the actuator can be moved to open the valve at the same time that the bottle is squeezed, and air or vent for the dispenser.

2. A sterile liquid dispenser comprising:

a. a squeeze bottle having an interior and a discharge opening, b. a discharge head comprising:

(1) a base sealingly disposed in the opening and formed with an outward tubular stem defining a discharge chamber having an inner end and an outer end, the outer end communicating to a discharge port at the distal end of the stem, (2) a resilient check valve disposed between the interior of the bottle and the inner end of the chamber and permitting movement of fluid from the interior of the bottle into the chamber but blocking fluid movement in the reverse direction, (3) a tubular shell disposed about the stem, the stem and shell being moveable relative to each other, and the shell carrying at its outer end an annular tip valve having a closed condition engaging the distal end of the stem to close off the discharge port, and an open condition at least partly spaced from the distal end to permit discharge, and c. a vent in the dispenser structured to permit air to enter through the vent into the interior of the bottle but not permit passage of liquid out through it.

3. A sterile liquid dispenser as claimed in claim 2 wherein the annular tip valve is a resilient annular gasket and the distal end of the stem is rigid.

4. A sterile liquid dispenser as claimed in claim 3 wherein the shell is moveable by a lever arm having an end disposed adjacent a side of the squeeze bottle.

5. A sterile liquid dispenser as claimed in claim 4 wherein the arm moves the shell longitudinally of the stem.

6. A sterile liquid dispenser as claimed in claim 5 wherein the shell contains a spring urging the shell toward the base, the spring surrounding the stem.

7. A sterile liquid dispenser as claimed in claim 6 wherein the lever arm is L-shaped having a long and a short arm and the short arm is disposed between the shell and the base.

8. A sterile liquid dispenser as claimed in claim 2 wherein the check valve is a duck bill valve.

9. A sterile liquid dispenser as claimed in claim 2 wherein the base supports an outward projection extending into the inner end of the discharge chamber and having a passage from the interior of the bottle to an outlet on the periphery of the projection and the check valve is a resilient sleeve which snugly surrounds the periphery of the projection over the outlet.

10. A sterile liquid dispenser as claimed in claim 2 wherein the vent is a passage in the base occluded by a hydrophobic filter.

11. A sterile liquid dispenser comprising:

a. a resilient squeeze bottle having an interior and a discharge opening, b. a discharge head comprising:

(1) a base sealingly disposed in the opening and formed with an outward tubular stem, (2) a gasket disposed on the distal end of the stem to comprise a discharge valve, (3) a resilient check valve disposed between the interior of the bottle and the stem permitting movement of fluid from the interior of the bottle into the stem but blocking fluid movement in the reverse direction, (4) a discharge chamber defined by structure coextensive with the stem and having an inner end and an outer end, the check valve at the inner end and the discharge valve at its outer end, (5) a tubular shell disposed about the stem and chamber, the shell carrying the gasket and the stem and shell being moveable relative to each other, so that movement of the shell will move the gasket away from the stem to open the discharge valve, and (6) an actuator lever for the shell, the lever extending down alongside the side wall of the bottle, c. a vent in the dispenser structured to permit air to enter through the vent into the interior of the bottle but not permit passage of liquid out through it.

12. A sterile liquid dispenser as claimed in claim 11 wherein the stem and the shell are moveable longitudinally with respect to each other to open the discharge valve.

13. A sterile liquid dispenser as claimed in claim 11 wherein the shell and the stem are moveable laterally with respect to each other to open the discharge valve.

* * * * *